US011851830B2

(12) United States Patent
Ponstein et al.

(10) Patent No.: US 11,851,830 B2
(45) Date of Patent: Dec. 26, 2023

(54) METHOD FOR REGULATING THE HEIGHT OF A SIDE SHIELD OF A GROUND MILLING MACHINE, AND GROUND MILLING MACHINE

(71) Applicant: BOMAG GmbH, Boppard (DE)

(72) Inventors: Joachim Ponstein, Boppard (DE); Thomas Thelen, Boppard (DE)

(73) Assignee: BOMAG GmbH, Boppard (DE)

( * ) Notice: Subject to any disclaimer, the term of this patent is extended or adjusted under 35 U.S.C. 154(b) by 283 days.

(21) Appl. No.: 17/311,765

(22) PCT Filed: Dec. 17, 2019

(86) PCT No.: PCT/EP2019/000344

§ 371 (c)(1),
(2) Date: Oct. 26, 2021

(87) PCT Pub. No.: WO2020/135923

PCT Pub. Date: Jul. 2, 2020

(65) Prior Publication Data

US 2022/0042256 A1 Feb. 10, 2022

(30) Foreign Application Priority Data

Dec. 28, 2018 (DE) ..... 102018010151.8

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 21/00; E01C 23/065; E01C 23/088; E01C 23/127
See application file for complete search history.

(56) References Cited

U.S. PATENT DOCUMENTS 10,094,078 B2 10/2018 Husar
2013/0082508 A1* 4/2013 Orefice ..... E01C 23/088 299/10

(Continued)

FOREIGN PATENT DOCUMENTS

DE 102014017892 A1 6/2016
DE 102017005814 A1 12/2017
DE 102017012124 A1 7/2019

OTHER PUBLICATIONS

German Patent and Trademark Office, Search Report, German Patent Application No. DE102018010151.8, dated Nov. 25, 2019 (5 pages).

(Continued)

*Primary Examiner* — Abby J Flynn
*Assistant Examiner* — Michael A Goodwin
(74) *Attorney, Agent, or Firm* — Wood Herron & Evans LLP

(57) ABSTRACT

The present invention relates to a method for controlling a distance of a height-adjustable side shield of a milling drum box of a ground milling machine, in particular a road milling machine, a recycler or a stabilizer, in vertical direction with respect to the ground, comprising the steps of: ascertaining a reference value for the height setting of the side shield from operating parameters of the ground milling machine, determining a desired distance (d) between the side shield and the ground, the desired distance (d) ensuring the safety of persons located next to the ground milling machine, ascertaining a necessary height setting of the side shield from the reference value and the desired distance (d), and setting the position of the side shield with respect to the ground in observance of the desired distance (d), so that the side shield is guided, in vertical downward direction, without contact to the ground. Moreover, the present invention (Continued)

relates to a ground milling machine with a control device for carrying out the method.

15 Claims, 6 Drawing Sheets

(56) References Cited

U.S. PATENT DOCUMENTS

| | | | | |
|---|---|---|---|---|
| 2014/0035343 | A1* | 2/2014 | Berning | E01C 23/127 299/1.5 |
| 2016/0160455 | A1* | 6/2016 | Vogt | E01C 23/127 299/1.5 |
| 2017/0254032 | A1* | 9/2017 | Husar | E01C 23/088 |
| 2017/0362784 | A1 | 12/2017 | Hoffmann et al. | |
| 2019/0203430 | A1 | 7/2019 | Wachsmann et al. | |

OTHER PUBLICATIONS

European Patent Office, International Search Report and Written Opinion of the International Searching Authority, International Application No. PCT/EP2019/000344, dated Apr. 1, 2020 (12 pages).

* cited by examiner

METHOD FOR REGULATING THE HEIGHT OF A SIDE SHIELD OF A GROUND MILLING MACHINE, AND GROUND MILLING MACHINE

CROSS-REFERENCE TO RELATED APPLICATIONS

The present application is a U.S. National Stage entry under 35 U.S.C. § 371 of, and claims priority to, International Application No. PCT/EP2019/000344, filed Dec. 17, 2019, which claims priority to DE102018010151.8, filed Dec. 28, 2018, the disclosures of which are hereby incorporated herein by reference in their entireties.

FIELD OF THE INVENTION

The present invention relates to a method for controlling a distance of a height-adjustable side shield of a milling drum box of a ground milling machine, in particular a road milling machine, a recycler or a stabilizer, in vertical direction with respect to the ground. Moreover, the present invention relates to a ground milling machine with a control device configured to carry out the method.

BACKGROUND OF THE INVENTION

Generic ground milling machines, such as road milling machines, recyclers, stabilizers or surface miners, are used in road and pathway construction or for mining mineral resources in opencast mining operation. They have a machine frame supported by traveling units, on which a milling drum mounted for rotation about a rotation axis inside a milling drum box is arranged. By rotating the milling drum equipped with milling tools, the ground milling machines remove the ground at a desired depth in a working direction. The traveling units of the ground milling machines may be crawler tracks and/or wheels. They are usually connected to the machine frame via height-adjustable lifting columns. Height adjustment of the lifting columns lifts or lowers the entire machine frame together with the milling drum box, which also allows the milling depth of the milling drum to be set. Furthermore, it is possible to adjust individual lifting columns, such as the two front lifting columns or the two rear lifting columns together to set the longitudinal inclination of the ground milling machine (i.e., the horizontal inclination in the milling direction) and/or the two right or left lifting columns relative to the longitudinal center of the machine to set the transverse inclination of the ground milling machine (i.e., the horizontal inclination transverse to the milling direction). Typically, a control device is provided that, among other things, controls this height adjustment based on input from the operator of the ground milling machine.

The milling drum is usually mounted for rotation inside a milling drum box which is typically attached to the machine frame and, in particular, moves up and down with it when the height of the machine frame is adjusted via the lifting columns of the traveling units. The milling drum box surrounds the milling drum like a hood and is open towards the ground. It usually has two side shields that close off the milling drum box parallel to the working direction. The side shields are usually mounted such that they are movable relative to the machine frame, and, in particular, height-adjustable in vertical direction. For this purpose, at least one actuator is articulated to the side shield, which can drive the height adjustment movement of the side shield. This actuator may further be arranged, for example, on the machine frame or on the milling drum box. Ideally, two actuators are provided per side shield, more specifically one actuator positioned at the front in the working direction and one actuator positioned at the rear in the working direction, which connect the machine frame and/or the milling drum box to the side shield and can move it up and down. Such an arrangement may be provided for both the right-hand and left-hand side shields viewed in the milling direction. Typically, the actuators are hydraulic cylinders. As an alternative to hydraulic cylinders, however, electric actuators, in particular electric linear motors/actuators, may also be used. In the prior art, it is known that the side shields rest on the ground during working operation and slide over it with skids. Together with the rest of the milling drum box, they prevent milled material from being thrown out of the milling track.

One problem is that the side shields get jammed or stuck during operation. In particular, the side shields may collide with obstacles or sink into soft ground material, such as the verges. This can damage the side shields and other parts of the milling drum box. Typically, a pushbutton switch is provided for these situations, allowing an operator to briefly lift the respective side shield. For safety reasons, the side shield is automatically lowered back to the ground as soon as the pushbutton is no longer pressed. However, manual lifting of the side shield requires the operator's constant control and attention on the one hand and is a safety risk on the other as there is a danger of lifting the side shield too long or too far while the milling rotor is running, so that milled material thrown around inside the milling drum box can get outside and endanger bystanders. This problem has been addressed in the prior art by developing automated systems that automatically lift the side shields in the event of a collision with an obstacle or sinking until the obstacle has been overcome and then return them to the floating position in which they slide on the ground. Such a system is known, for example, from DE 10 2014 017 892 A1. However, this system is based on detecting, for example, a sinking of the side shield, which is then responded to automatically. However, since activation requires, for example, prior sinking, damage to the side shield cannot be completely ruled out. Moreover, the side shield may also get jammed and suffer damage during lifting after a collision.

One aspect of the present invention is to provide a method and a ground milling machine in which the side shields are reliably protected from jamming or sinking in, so that disturbances of the milling operation are avoided and damage to the side shields occurs less frequently.

SUMMARY OF THE INVENTION

Specifically, in a method described above, one aspect of the present invention is achieved through the steps of ascertaining a reference value for the height setting of the side shield from operating parameters of the ground milling machine, determining a desired distance between the side shield and the ground, the desired distance ensuring the safety of persons located next to the ground milling machine, ascertaining a necessary height setting of the side shield from the reference value and the desired distance, and setting the position of the side shield relative to the ground in accordance with the desired distance, so that the side shield is guided, in vertical downward direction, without contact to the ground. The basic aspect of the present invention is to deviate from previous practice by no longer lowering the side shield(s) of the milling drum box so far that they rest on the ground. As described above, in the prior art, side shields are lowered to the ground and kept on the ground with a certain pressure, so that they are guided in a so-called floating position sliding over the ground during working operation. The present invention now deviates from this by setting a distance in the sense of a clear height between the side shield, in particular the bottom edge of the side shield, i.e., the surface delimiting the side shield vertically downwards or in the direction towards the ground, and the ground. This spacing, i.e., the clear height, corresponds to the desired distance. According to the present invention, the side shield(s) is/are therefore not guided in a floating position resting on the ground, but in a hovering position hovering above the ground or at a distance from the ground. In this manner, most collisions of the side shields with obstacles, which usually protrude very little in the vertical direction, are avoided. Moreover, sinking of the side shields into soft ground is ruled out, since according to the present invention the side shields are not pressed onto the ground and are not in contact with it.

The present invention thus relates to the control of the height adjustment or the height position of at least one side shield and, in particular, of all side shields of a ground milling machine. The distance in the vertical direction with respect to the ground therefore describes the clear height between the side shield and the ground. When the side shield rests on the ground, the distance is zero. The distance increases when the side shield is adjusted vertically upwards and a gap is formed between the side shield and the ground. For the sake of completeness, the distance could assume negative values if the side shield were to sink into soft ground, which, however, is avoided according to the present invention. The distance is measured between the vertically lower edge of the side shield, also referred to as the near-ground edge, and the ground. In particular, the vertically lower edge is the edge of the side shield with which the side shield ends in the direction towards the ground. In the prior art, this edge of the side shield is guided resting on the floor. The desired distance set between the side shield and the ground according to the present invention is therefore selected such that, on the one hand, it prevents the side shield from resting on the ground, so that the advantages according to the present invention are obtained. In addition, the desired distance must of course be selected such that the safety of bystanders in the vicinity of the ground milling machine is reliably ensured. The margin that must be observed in determining the desired distance is therefore dictated by the pertinent relevant safety regulations. Such safety distances, which correspond to the desired distance, are specified, for example, in the ISO 13857 standard. The desired distance is therefore selected or determined such that it lies within the permissible range of relevant safety regulations, in particular the ISO 13857 standard. This ensures that persons in the vicinity of the ground milling machine are not endangered. Such a distance is thus a desired distance that ensures the safety of persons located next to the ground milling machine. Therefore, the desired distance is either determined mathematically from operating parameters of the ground milling machine within the interval specified by the safety regulations, or is determined by an operator, for example by entering the desired distance into a control device. Only values within the interval specified by the safety regulations can be selected here as well.

In order to control the height setting of the side shield in such a way that the desired distance between the ground and the side shield is maintained, a reference value for the height setting is required. This reference value is taken from the operating parameters of the ground milling machine. The reference value is used to determine where, with respect to its height setting, the side shield must be placed so that the desired distance between the side shield and the ground is set. According to one embodiment of the present invention, the reference value comprises the current milling depth of the ground milling machine. The current milling depth of the ground milling machine indicates how deep the milling drum engages the ground during working operation in order to remove it. The height setting of the side shield can then be performed as a relative positioning in relation to the milling depth, for example by setting a fixed value for the height position of the side shield as a function of the milling depth. Thus, when an operator sets a milling depth of the ground milling machine, the necessary height position or height setting of the side shield, which results in observance of the desired distance above the ground, is ascertained from this milling depth in consideration of the desired distance. Moreover, the value of the desired distance may, in particular, be adapted to the set milling depth. For example, the desired distance may be increased or decreased with increasing milling depth, of course still within the intervals specified by the relevant safety regulations. This adaptation may also be performed dynamically during operation when the milling depth is changed.

In addition to a fixed value for each milling depth, according to one embodiment of the present invention, the current height position of the side shield may also be used as an operating parameter of the ground milling machine. This requires measuring the current height position of the side shield, especially with respect to the ground. It is therefore possible that measuring, in particular contactless measuring, of the current vertical distance of the side shield to the ground is carried out by means of a distance sensor, and that the reference value used in the method according to the present invention comprises this measured current distance of the side shield to the ground. Generally, any suitable distance sensors known in the prior art, such as laser sensors or ultrasonic sensors, may be used for this purpose. By determining the current distance of the side shield from the ground, for example by means of a distance sensor mounted at a defined distance from the bottom edge of the side shield, the desired distance between the side shield and the ground can be set particularly easily and accurately.

The measuring point of the distance sensor may, for example, be located directly next to the side shield transversely to the working direction of the ground milling machine. In one exemplary embodiment, however, the current vertical distance of the side shield from the ground is measured in front of the side shield in the working direction of the ground milling machine. For example, when the ground milling machine is moving in the working direction, the measuring point of the distance sensor is therefore located in a track on the ground over which the side shield is guided at a vertical distance from the ground. In the case of a prior art side shield, the bottom edge of the side shield would therefore run or slide over the track and thus also the previous measuring point of the distance sensor. This ensures that the measurement of the current distance actually detects the clear height between the side shield and the ground. If the height were detected with respect to another measuring point over which the side shield is then not guided at a vertical distance, there could be an error in ascertaining the actual distance of the side shield from the ground if the ground vertically directly below the side shield is at a different height position than the ground on which the measuring point is located. Such errors thus occur, for example, when an obstacle projects upwards directly next to the side shield or the ground slopes downwards, especially in comparison to the track directly below the side shield.

To ensure the safety of bystanders during operation and also to protect the side shield from collisions and associated damage, it is advantageous if the height profile of the ground in front of the side shield in the working direction is detected either continuously or at least with a sufficient granularity. For example, during working operation, the ground milling machine may run over vertically projecting obstacles with which the side shield could collide or on which the side shield could get stuck. If the distance of the side shield from the ground directly in front of the side shield in the working direction of the ground milling machine is continuously monitored, such obstacles are recognized, so that a collision of the side shield with the obstacle can be prevented by adapting the height setting of the side shield. It is therefore possible that the height setting of the side shield is adapted to the current vertical distance of the side shield from the ground measured in front of the side shield in the working direction of the ground milling machine, in order to keep the side shield at the desired distance from the ground when the measured vertical distance changes. For example, the side shield may be lifted when the distance sensor detects that the ground immediately in front of the side shield in the working direction rises vertically upwards, in particular, with respect to the ground directly vertically below the side shield. Similarly, of course, the side shield may additionally be lowered when the distance sensor detects that the ground immediately in front of the side shield in the working direction drops vertically downwards, in particular again with respect to the ground directly vertically below the side shield. In other words, the height setting of the side shield is controlled in such a way that even when the ground milling machine is moving, the distance of the side shield from the ground always corresponds as closely as possible to the desired distance. This includes automatic following of a contour of the ground by the side shield or by the height setting of the side shield. For this purpose, for example, other operating parameters of the ground milling machine may also be used for control, such as, in particular, its current traveling speed. Depending on the position of the measuring point of the distance sensor, it is possible to ascertain the distance that the ground milling machine must travel in order for a change in the elevation of the ground measured in front of the side shield to be located below the side shield. By considering the traveling speed of the ground milling machine, it is possible to control the height setting of the side shield particularly precisely and thus to keep the side shield at the desired distance from the ground particularly accurately while following a changing height profile of the ground.

Generally, it is already sufficient to adjust the height of the bottom edge of the side shield essentially parallel to the ground. As already explained at the beginning, however, it is advantageous if a separate actuator for height adjustment is arranged at the front and rear ends of the side shield in the working direction. In this case, independent control of the two actuators allows the height setting of the side shield to be controlled or regulated separately at the front in the working direction as well as at the rear in the working direction. In one exemplary embodiment of the present invention, this can be used to adapt the height setting of the side shield at the front and rear in the working direction separately and sequentially in time to changes in the current vertical distance of the side shield from the ground measured in front of the side shield. Such separate control of the height position of the side shield at the front and rear actuators means that the desired distance can be maintained particularly well even if the height contour of the ground is irregular and does not correspond to the linear shape of the bottom edge of the side shield. Otherwise, especially in the case of abrupt changes in the height of the ground, the desired distance may be exceeded or not achieved. However, exceeding the desired distance must be avoided as far as possible for safety reasons. In turn, falling below the desired distance entails the risk of the side shield colliding with obstacles or getting stuck, as in the prior art. Both should be avoided as far as possible, so that the actual distance of the side shield from the ground must be kept as close as possible to the desired distance.

This can also be done particularly efficiently if, on the one hand, two independent actuators are provided on the side shield and other operating parameters of the ground milling machine, for example its traveling speed, are also detected and used. It is therefore possible that the separate height setting of the side shield at the front and rear in the working direction is controlled based on a traveling speed of the ground milling machine, so that the desired distance of the side shield from the ground is not exceeded along an entire near-ground edge of the side shield. In this manner, the side shield follows the height profile of the ground particularly accurately during working operation of the ground milling machine and is automatically tilted upwards or downwards both at the front and the rear in the event of changes in the elevation of the ground or in the event of obstacles, as is required due to the currently measured distance of the side shield from the ground. By taking into account the traveling speed of the ground milling machine, elevations and depressions of the ground can be traversed, in particular precise observance of the desired distance. One aspect of the present invention is that the desired distance of the side shield from the ground is not exceeded along the entire length of the side shield extending in the working direction, so as to not endanger bystanders. If this is not possible due to a height profile of the ground during operation, this can be detected, for example by a control device, based on the height profile of the ground before the desired distance is exceeded. In this manner, it is possible that in the event of a necessary exceedance of the desired distance between the side shield and the ground a warning signal and/or a control command is generated, either to warn the operator and/or bystanders or to intervene directly in the working operation of the ground milling machine, for example to stop it.

On the other hand, falling below the desired distance can be tolerated temporarily, as this is not associated with an increased potential danger for bystanders. Thus, if this is necessary to maintain the desired distance along the entire bottom edge of the side shield, it may be possible to fall below the desired distance at some points. However, in order to ensure even during an evasive maneuver of the side shield that the side shield does not collide with an obstacle, for example an obstacle that has not been detected by the distance sensor, it is possible that the height setting of the side shield is controlled such that at least the desired distance of the side shield from the ground is always maintained at the front in the working direction. In other words, the end of the bottom edge of the side shield that is at the front in the working direction should always be guided at least at the desired distance from the ground. This means that falling below the desired distance should be avoided here in particular. In this manner, a collision of the side shield with an obstacle is avoided to the extent possible even if the distance sensor has not detected this obstacle.

One aspect of the present invention is also achieved with a ground milling machine, in particular a road milling machine, a recycler or a stabilizer, for processing a ground, with a drive unit, a machine frame and a traveling gear, a milling drum box arranged on the machine frame, in which a milling drum is mounted for rotation about a rotation axis, the milling drum box comprising at least one height-adjustable side shield, a sensor for detecting an operating parameter of the ground milling machine, and a control device. According to the present invention, the control device is configured to carry out the method described above. Accordingly, all features, advantages and effects of the method according to the present invention apply mutatis mutandis to the ground milling machine according to the present invention, so that reference is made to the above statements to avoid repetition. Moreover, all the features, advantages and effects described for the ground milling machine also apply to the method according to the present invention.

The sensor may be any type of sensor that can determine an operating parameter useful for the method according to the present invention. For example, it may be a sensor that determines the milling depth and/or the traveling speed of the ground milling machine. It is possible that the sensor comprises a distance sensor, in particular a contactless distance sensor, which determines the distance of the side shield from the ground. Laser sensors or ultrasonic sensors are particularly suitable for this purpose. Alternatively, however, it is also possible to use a tactile sensor as the distance sensor.

As described above, it is possible that the distance sensor measures the distance of the side shield from the ground at a point in front of the side shield in a working direction of the ground milling machine. In this way, the height setting of the side shield can be dynamically adapted to the height profile of the ground during working operation. The actual distance in vertical direction can then be easily calculated trigonometrically.

It is particularly advantageous for the present invention if the side shield has two independently operable actuators for separate height adjustment of the front and rear ends of the side shield in the working direction. In particular, it is possible that the side shield comprises a front hydraulic cylinder and a rear hydraulic cylinder that are configured to be adjustable independently of each other. In this manner, it is possible to follow a height profile of the ground particularly precisely during operation, so that the desired distance between the side shield and the ground is exceeded or fallen below as little as possible.

BRIEF DESCRIPTION OF THE DRAWINGS

The present invention will be explained in more detail below by reference to the embodiment examples shown in the figures. In the schematic figures.

Like parts or parts acting in a like manner are designated by like reference numerals. Recurring parts are not designated separately in each figure.

DETAILED DESCRIPTION OF THE INVENTION

Figure 1:
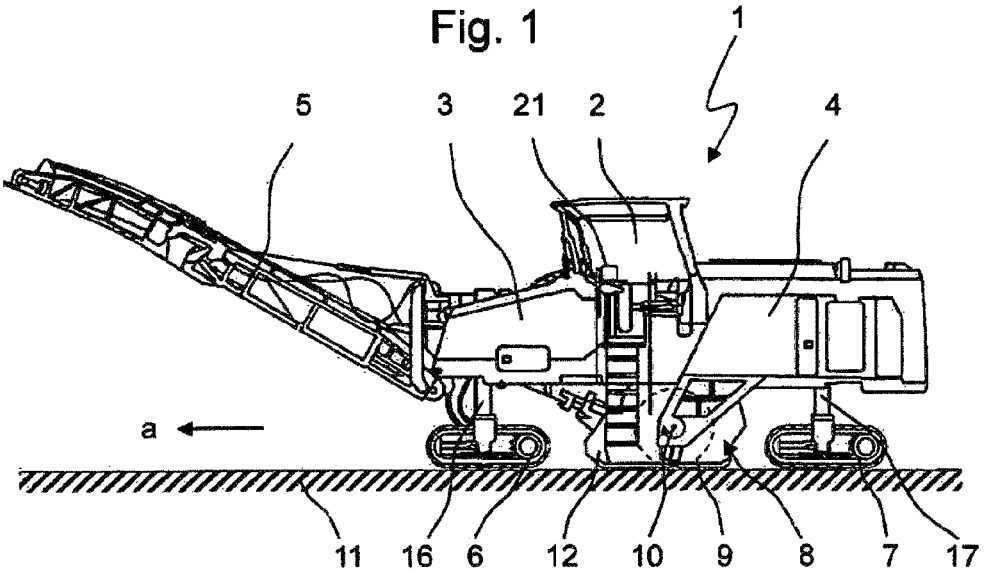
FIG. 1 is a side view of a road milling machine.
Figure 2:
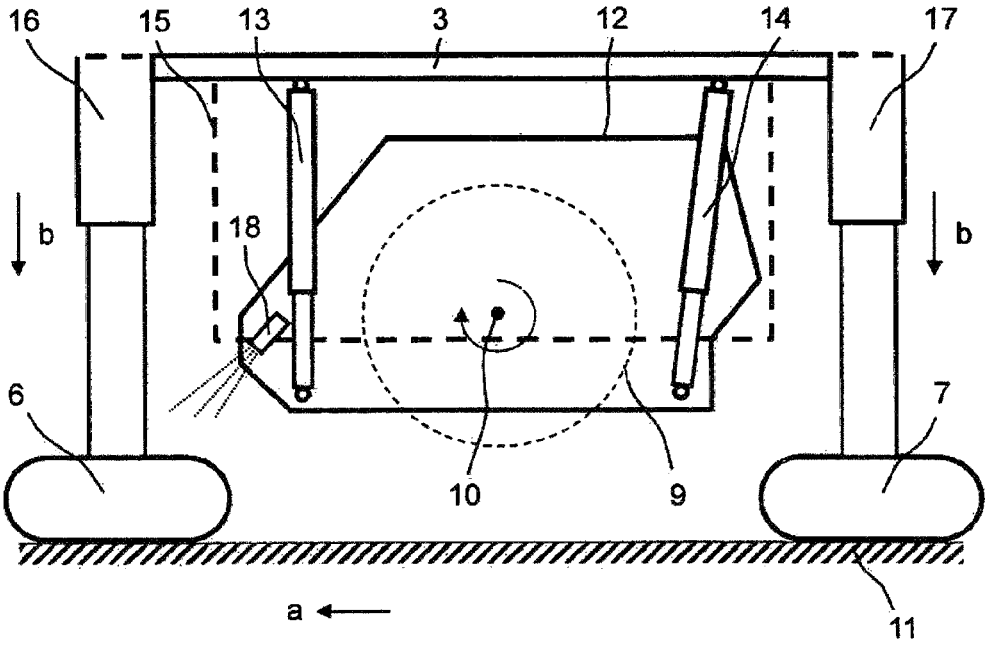
FIG. 2 is a side view of the traveling gear and the milling drum box with the milling drum lifted.

FIG. 1 shows a road milling machine, more specifically a cold milling machine of the center rotor type, as an example of a generic ground milling machine 1. The ground milling machine 1 comprises an operator platform 2 as well as a machine frame 3 and a drive unit 4, which is typically configured as a diesel combustion engine. During working operation, the ground milling machine 1 moves over the ground 11 in working direction a using a front traveling unit 6 on a front lifting column 16 and a rear traveling unit 7 on a rear lifting column 17. The traveling units 6, 7 are configured as crawler tracks in the example shown, but may also be wheels. A milling drum 9 is mounted in a milling drum box 8 for rotation about a rotation axis 10. During operation, the milling drum 9 partially engages the ground 11 and removes ground material, which is conveyed from the milling drum box 8 onto a discharge conveyor 5, which transfers the milled material onto a transport vehicle, typically a truck (not shown). On the sides of the milling drum box 8 located outside along the rotation axis 10, the milling drum box ends in a respective side shield 12. The side shield 12 serves as a boundary for the milling drum box 8 and prevents milled material removed by the milling drum 9 and thrown around inside the milling drum box 8 from escaping sideways and endangering, for example, persons located next to the ground milling machine 1. Moreover, the ground milling machine 1 comprises a control device 21 configured to carry out the method according to the present invention. An input device (not shown) via which the operator can enter a set value for the desired distance d (FIG. 3) may, for example, also be provided on the control device 21.

Figure 3:
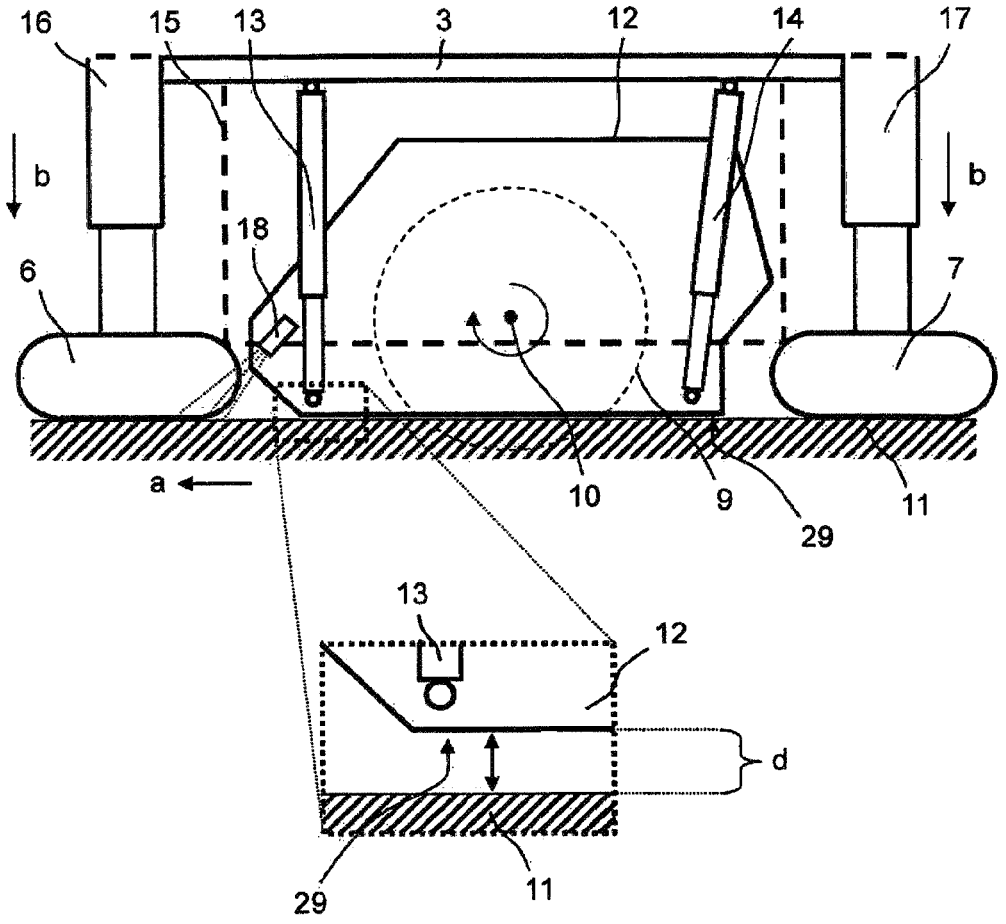
FIG. 3 is a side view of the traveling gear and the milling drum box with the milling drum lowered.

The milling drum box 8 and, in particular, the side shield 12 and its relative positioning with respect to the ground 11 are shown in FIGS. 2 to 8 as enlarged detail views. Since, in particular, the position of the side shield 12 is to be shown, the remainder of the milling drum box 8 is indicated by the dashed housing 15 for simplification. As can be seen, for example, in FIG. 2, the side shield 12 is mounted on the machine frame 3 so as to be height-adjustable via a front hydraulic cylinder 13 and a rear hydraulic cylinder 14. At the beginning of working operation, the ground milling machine 1 moves to its place of operation. There, the milling depth is set by adjusting the milling drum 9 together with the entire milling drum box 8 and the machine frame 3 downwards in the lowering direction b. This is done via the lifting columns 16, 17 of the traveling units 6, 7. FIG. 3 shows the milling drum 9 in the position lowered to the desired milling depth by the lifting columns 16, 17. This is the position in which the ground milling machine 1 is in working operation, i.e., in which it mills off ground material from the ground 11.

In addition, FIG. 3 also shows an enlarged detail view of the front end of the side shield 12 in the working direction a. In particular, this is the end of the side shield 12 on which the front hydraulic cylinder 13 is arranged. As exemplified for the enlarged detail view in FIG. 3, the entire near-ground edge 29, i.e., the bottom edge of the side shield 12, is spaced a desired distance d from the ground 11. In contrast to the prior art, the side shield 12 thus does not rest on the ground 11 while the ground milling machine 1 is milling off ground material with the milling drum 9 during working operation. Instead, the side shield 12 is held hovering at the desired distance d above the ground 11, and thus in a hovering position as opposed to the usual floating position. The distance d (vertical distance or distance perpendicular to the underlying ground) is, on the one hand, small enough to comply with safety regulations, for example, in particular ISO standard 13857, and, on the other hand, large enough to reliably prevent the side shield 12 from sinking into soft areas of the ground 11 and most collisions of the side shield 12 with obstacles projecting from the ground 11. In order to be able to set the desired distance d between the side shield 12 and the ground 11, a height reference or a reference value for the height setting of the side shield 12 is required. In the embodiment example shown, the current distance of the side shield 12 from the ground 11 is used as the operating parameter of the ground milling machine 1 for this purpose. Said distance is provided by the distance sensor 18, which in the embodiment example shown is configured as a contactless distance sensor 18, for example a laser sensor or an ultrasonic sensor. The distance sensor 18 is arranged on the side shield 12, so that it is adjusted in height together with the latter. In this manner, the distance of the side shield 12 from the ground 11 measured by the distance sensor 18 can be used as a control variable for setting the desired distance d.

Figure 4:
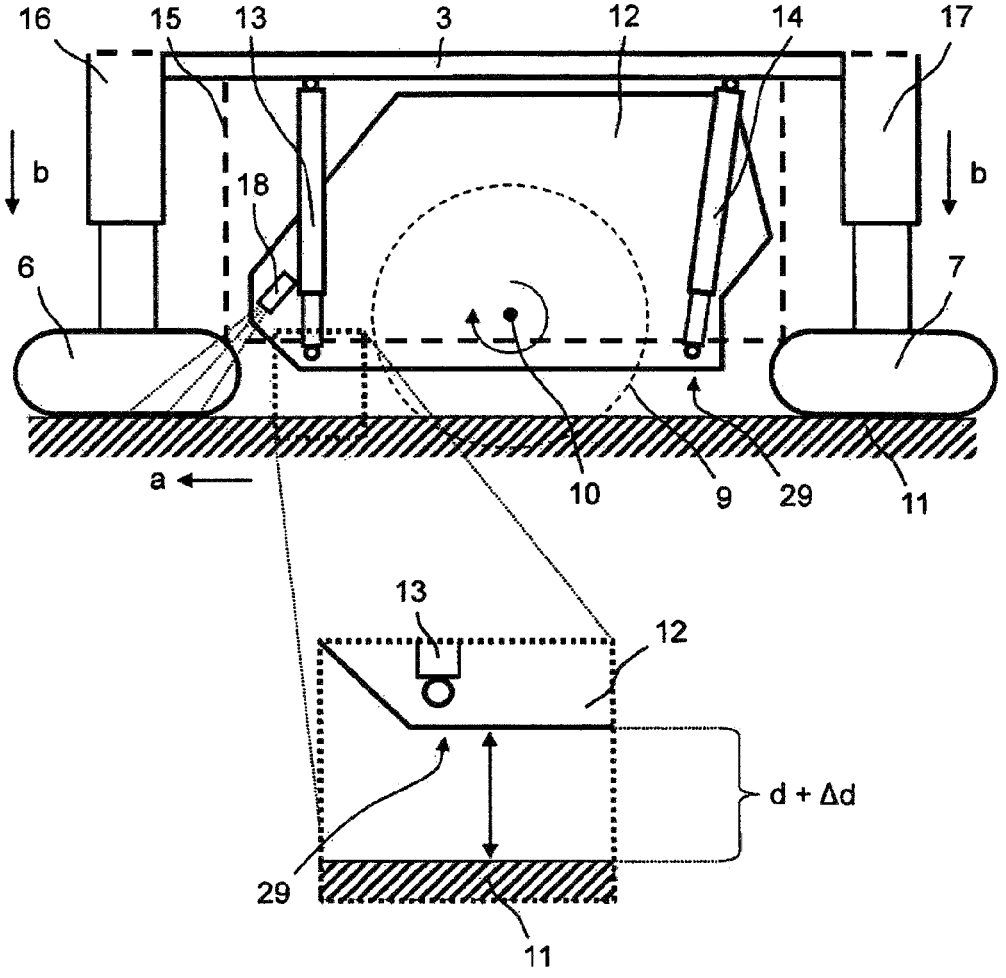
FIG. 4 is a side view of the traveling gear and the milling drum box with the side shield lifted manually.

FIG. 4 shows that by adjusting the front hydraulic cylinder 13 and the rear hydraulic cylinder 14 in parallel, the side shield 12 can be removed from the ground 11 uniformly at the front and the rear. In particular, the near-ground edge 29 of the side shield 12 is lifted parallel to the ground 11. This happens when the operator wants to manually adjust the side shield 12 upwards for a short time by operating an input device 19 (see, FIG. 9), for example to avoid a larger obstacle. As long as the operator presses the input device 19, which is configured, for example, as a pushbutton, the side shield 12 is lifted vertically upwards by a safety distance Δd with an entire bottom edge 29. As soon as the operator releases the pushbutton, the side shield 12 is lowered back to the desired distance d according to the present invention. The operator can therefore use the pushbutton in the usual manner to adjust the side shield 12 as a whole.

Figure 5:
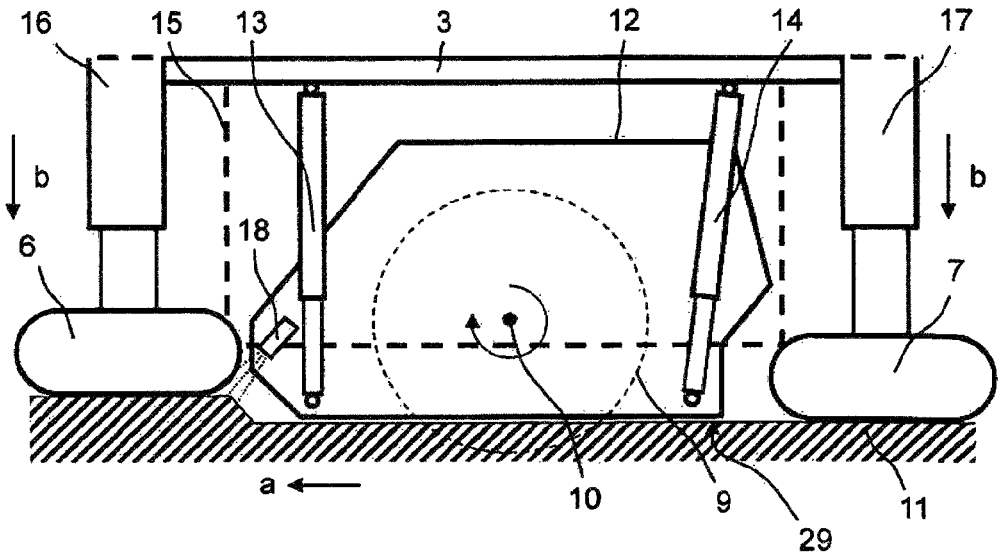
FIGS. 5-8 are further side views of the traveling gear and the milling drum box during automatic evasive maneuvering due to an obstacle.
Figure 6:
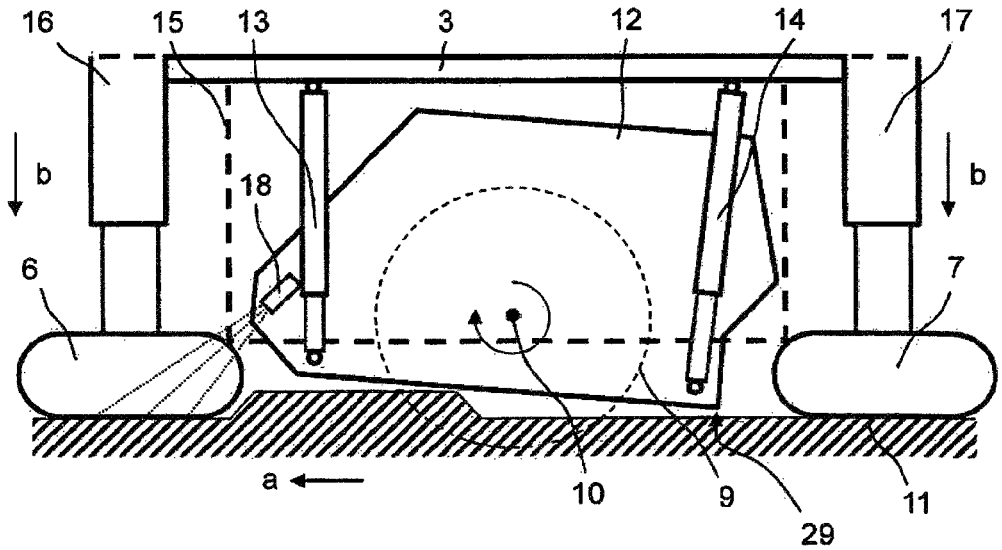
Figure 7:
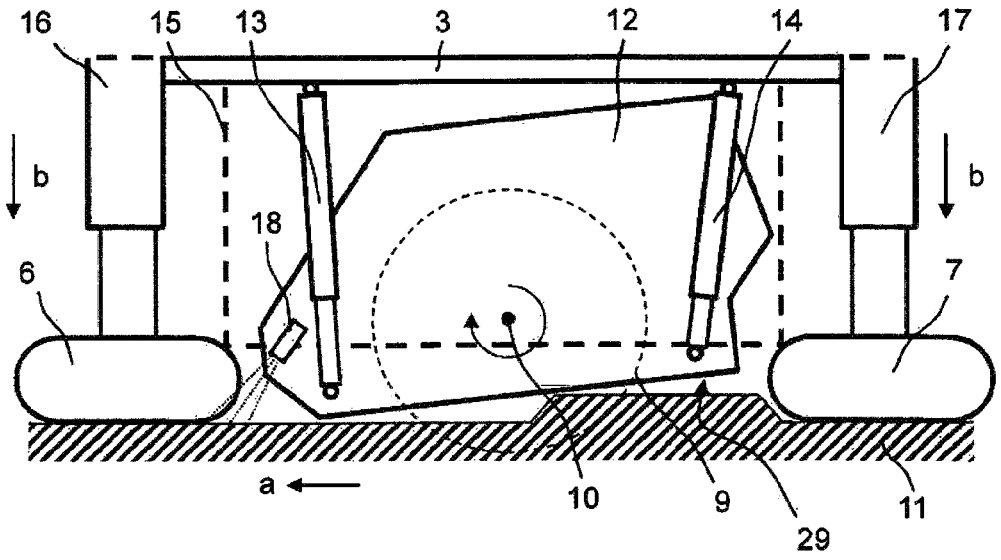
Figure 8:
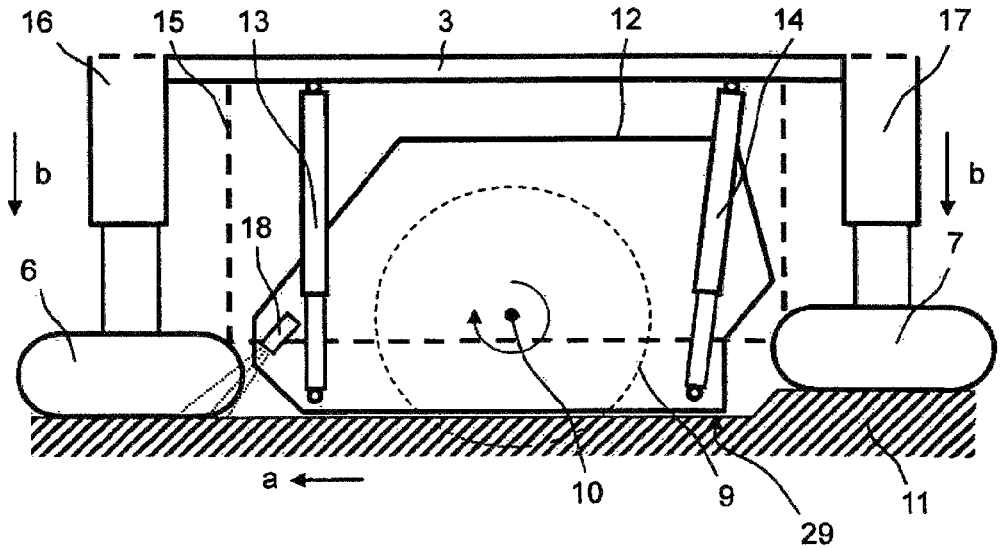

FIGS. 5 to 8 show how, in accordance with the present invention, the side shield 12 follows the height profile of the ground 11 while the side shield 12 is kept, as far as possible, within the range of the desired distance d from the ground 11. In particular, FIG. 5 shows an obstacle on the ground 11 approaching the side shield 12 from the front. The distance sensor 18 senses an ascending elevation of the ground 11 in the working direction a immediately in front of the side shield 12. The control device 21 (see, FIG. 1) also takes into account the traveling speed of the ground milling machine 1 in working direction a and controls the front hydraulic cylinder 13 of the side shield 12 in such a way that it lifts the front end of the side shield 12. In this way, the side shield 12 is lifted above the obstacle before the side shield 12 collides with it. The collision is thus prevented. The rear end of the side shield 12, on the other hand, is not yet lifted by the rear hydraulic cylinder 14 in order to prevent, as far as possible, the desired distance d from being exceeded in this region. The rear hydraulic cylinder 14 may even lower the side shield 12 at the rear end to less than the desired distance d in order to prevent the distance between the near-ground edge 29 and the ground 11 from exceeding the desired distance d too much in the working direction a in the middle of the near-ground edge 29 of the side shield 12. This is a particular risk at those points where the elevation of the ground 11 changes particularly abruptly, as can be seen, for example, in FIG. 6. If the ground milling machine 1 now travels further in working direction a, the distance sensor 18 senses that the ground 11 behind the obstacle drops back, so that it is a locally limited obstacle. Thus, while the rear hydraulic cylinder 14 also lifts the rear end of the side shield 12 when the obstacle has been passed, for example in working direction a, by half the side shield 12, the side shield 12 is already lowered back at the front end by the front hydraulic cylinder 13, as illustrated in FIG. 7. Again, the front hydraulic cylinder 13 may bring the side shield 12 closer to the ground 11 in the front region than would be specified by the desired distance d. Alternatively, however, it is also possible that at least the desired distance d is maintained in the front region at all times in order to prevent unexpected collisions of the side shield 12 with other obstacles not detected by the distance sensor 18. FIG. 8 then finally shows the situation in which the obstacle has already been completely overcome by the side shield 12. Both the front hydraulic cylinder 13 and the rear hydraulic cylinder 14 have repositioned the side shield 12 at the desired distance d from the ground 11 along its entire near-ground edge 29. The side shield 12 has thus avoided the obstacle on the ground 11 such that it has never come into contact with it. At the same time, safety-relevant exceedance of the desired distance d was avoided as far as possible. It is to be understood that an analogous description would also have been possible with respect to a depression in the ground 11. The corresponding sequence is the same as that described for a protruding obstacle, except that the front end of the side shield 12 is lowered first and is followed by the rear end of the side shield 12 with a time delay, so that a separate description is not necessary.

Figure 9:
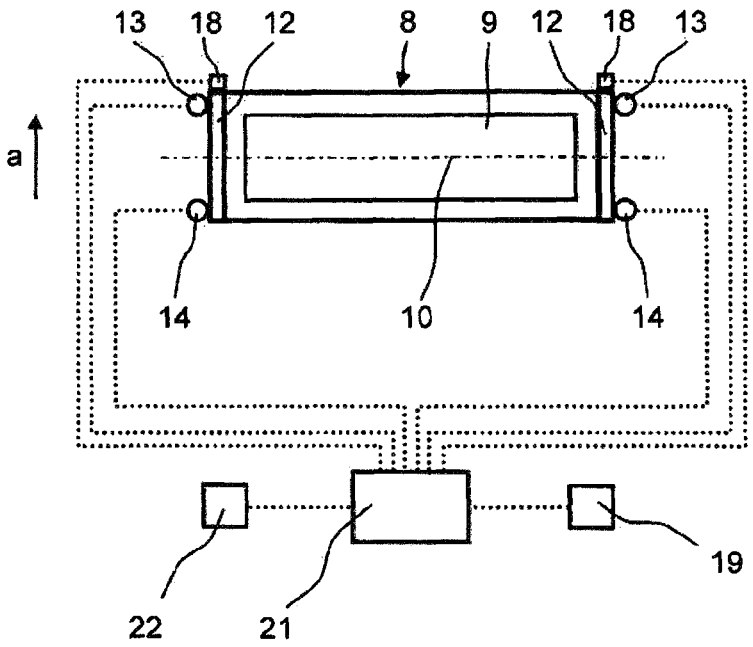
FIG. 9 shows the control device and its interconnections with the other components.

FIG. 9 shows a schematic top view of the operating principle of the control device 21. The control device 21 may, for example, be part of or connected to the on-board computer of the ground milling machine 1. It is connected to and controls both the front hydraulic cylinder 13 and the rear hydraulic cylinder 14 of the side shield 12. This applies to both the left and right side shields 12 of the milling drum box 8, for each of which the present invention is used separately but analogously. In the embodiment example shown, the same control device 21 is used for both sides, although separate control devices 21 could also be used. The control device 21 is also connected to the distance sensor 18 arranged on the respective side shield 12 and receives the distance values measured by the sensor. In addition, the control device 21 also has at its disposal, for example, the current traveling speed of the ground milling machine 1 in the working direction a. In this manner, the control device 21 can carry out the method according to the present invention and ensure that the side shields 12 automatically follow the height profile of the ground 11 while maintaining, as far as possible, the desired distance d from the ground 11. To enable manual lifting of the side shield 12, the control device 21 is also connected to an input device 19, which is configured as a pushbutton switch. As long as the pushbutton switch or the input device 19 is pressed by the operator, the side shield 12 is uniformly lifted by the safety distance Δd at both the front and the rear. Only when the input device 19 is no longer actuated is the side shield 12 lowered back to the desired distance d from the ground 11. Finally, the control device 21 also comprises an emergency stop switch 22 with which an operator can abort the method according to the present invention, for example in case of imminent danger. When the emergency stop switch 22 is actuated, the control device 21 may either simply discontinue adjusting the side shield 12 any further or the side shield 12 may be lowered down to the ground 11 so that the side shield 12 comes into contact with the ground 11 and completely closes the side of the milling drum box 8.

Figure 10:
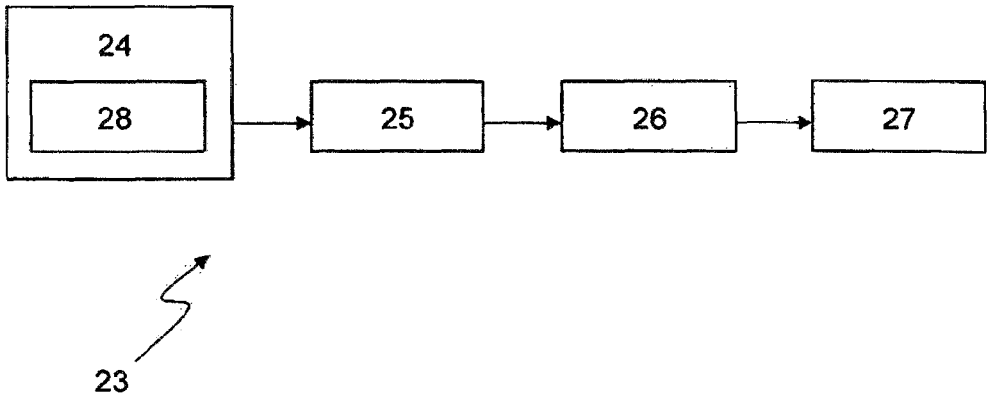
FIG. 10 is a flow chart of the method.

FIG. 10 shows a flowchart of the method 23. The method 23 starts with ascertaining 24 a reference value for the height setting of the side shield 12 from operating parameters of the ground milling machine 1. For example, ascertaining 24 may comprise measuring 28 the current vertical distance of the side shield 12 from the ground 11. The desired distance d between the side shield 12 and the ground 11 is defined either as a function of the ascertained reference value or, for example, once in advance by an operator selecting the desired distance d within the specified safety-relevant interval, which is then stored by the control device 21. Determining 25 the desired distance d therefore refers either to a calculation of this distance d from the reference value according to a calculation rule or to retrieval of the value given, for example, by the operator. The reference value and the desired distance d are then used to ascertain 26 the necessary height setting of the side shield 12. The necessary height setting thus takes into account both where the side shield 12 is currently located with respect to the height adjustment and how large the desired distance d should be. Finally, the control device 21 controls the front hydraulic cylinder 13 and the rear hydraulic cylinder 14 such that setting 27 of the position of the side shield 12 with respect to the ground 11 in observance of the desired distance d is performed. The fact that the side shield 12 is guided hovering above the ground 11 in the method 23 according to the present invention and therefore normally does not come into contact with the ground 11 results in considerably less damage to the side shield 12 and significantly reduced work interruptions due to jammed or sunken side shields 12. Overall, therefore, the wear of the ground milling machine 1 is reduced, which reduces costs, and the working operation of the ground milling machine 1 is facilitated, which also reduces operating costs. At the same time, due to compliance with the safety regulations, safe working is also ensured for personnel walking next to the ground milling machine 1.

While various aspects in accordance with the principles of the present invention have been illustrated by the description of various embodiments, and while the embodiments have been described in considerable detail, they are not intended to restrict or in any way limit the scope of the present invention to such detail. The various features shown and described herein may be used alone or in any combination. Additional advantages and modifications will readily appear to those skilled in the art. The present invention in its broader aspects is therefore not limited to the specific details, representative apparatus and methods and illustrative examples shown and described. Accordingly, departures may be made from such details without departing from the scope of the general inventive concept.

What is claimed is:

1. A method for controlling a distance of a height-adjustable side shield of a milling drum box of a ground milling machine in vertical direction with respect to the ground, comprising the steps of:

a) ascertaining a reference value for a height setting of the side shield from operating parameters of the ground milling machine;

b) determining a desired distance (d) between the side shield and the ground;

c) determining a necessary height setting of the side shield from the reference value and the desired distance (d); and d) setting a position of the side shield with respect to the ground in observance of the desired distance (d) so that the side shield is guided, in vertical downward direction, without contact to the ground, wherein the reference value in step a) comprises a current milling depth of the ground milling machine, and wherein the desired distance (d) is dynamically adjusted during working operation when the current milling depth changes.

2. The method according to claim 1, wherein measuring of a current vertical distance of the side shield from the ground is performed by a distance sensor and the reference value in step a) comprises the measured current vertical distance of the side shield from the ground.

3. The method according to claim 2, wherein the current vertical distance of the side shield from the ground is measured at a point in front of the side shield in a working direction (a) of the ground milling machine.

4. The method according to claim 3, wherein the height setting of the side shield is adapted to the current vertical distance of the side shield from the ground measured at the point in front of the side shield in the working direction (a) of the ground milling machine in order to keep the side shield at the desired distance (d) from the ground when the measured vertical distance changes.

5. The method according to claim 4, wherein a height setting of the side shield at the front and rear in the working direction (a) is adapted separately and sequentially in time to changes in the current vertical distance of the side shield from the ground measured at the point in front of the side shield.

6. The method according to claim 5, wherein the separate height setting of the side shield at the front and rear in the working direction (a) is controlled based on a traveling speed of the ground milling machine, so that the desired distance (d) of the side shield from the ground is not exceeded along an entire near-ground edge of the side shield.

7. The method according to claim 6, wherein a height adjustment of the side shield is controlled such that at least the desired distance (d) of the side shield from the ground is always maintained at the front in the working direction (a).

8. The method according to claim 2, wherein measuring of the current vertical distance of the side shield from the ground is by contactless measuring.

9. The method according to claim 1, wherein the ground milling machine comprises a road milling machine, a recycler or a stabilizer.

10. A ground milling machine for processing a ground, comprising:

a drive unit;

a machine frame and a traveling gear;

a milling drum box arranged on the machine frame, in which a milling drum is mounted for rotation about a rotation axis, the milling drum box comprising at least one height-adjustable side shield;

a sensor for detecting an operating parameter of the ground milling machine; and a control device, wherein the control device is configured to carry out the method according to claim 1.

11. The ground milling machine according to claim 10, wherein the sensor comprises a distance sensor which determines a distance of the side shield from the ground.

12. The ground milling machine according to claim 11, wherein the distance sensor measures a current vertical distance of the side shield from the ground at a point in front of the side shield in a working direction (a) of the ground milling machine.

13. The ground milling machine according to claim 11, wherein the distance sensor is a contactless distance sensor.

14. The ground milling machine according to claim 10, wherein the side shield comprises a front hydraulic cylinder and a rear hydraulic cylinder which are configured to be adjustable independently of one another.

15. The ground milling machine according to claim 10, wherein the ground milling machine comprises a road milling machine, a recycler or a stabilizer.

* * * * *